US010118223B2

(12) United States Patent
Eason

(10) Patent No.: US 10,118,223 B2
(45) **Date of Patent: *Nov. 6, 2018**

(54) METHODS OF FORMING BODIES FOR EARTH-BORING DRILLING TOOLS COMPRISING MOLDING AND SINTERING TECHNIQUES

(71) Applicant: Baker Hughes Incorporated, Houston, TX (US)

(72) Inventor: Jimmy W. Eason, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 615 days.

This patent is subject to a terminal disclaimer.

(21) Appl. No.: 14/795,747

(22) Filed: Jul. 9, 2015

(65) Prior Publication Data

US 2015/0306663 A1 Oct. 29, 2015

Related U.S. Application Data

(63) Continuation of application No. 12/341,663, filed on Dec. 22, 2008.

(51) Int. Cl.
*B22F 3/10* (2006.01)
*B22F 3/00* (2006.01)
(Continued)

(52) U.S. Cl.
CPC ..... *B22F 3/004* (2013.01); *B22F 1/0062* (2013.01); *B22F 3/225* (2013.01); *B22F 3/24* (2013.01);
(Continued)

(58) Field of Classification Search
CPC ..... B33F 7/06
See application file for complete search history.

(56) References Cited

U.S. PATENT DOCUMENTS 3,962,173 A 6/1976 Wick et al.
4,094,709 A 6/1978 Rozmus
(Continued)

FOREIGN PATENT DOCUMENTS

EP 1598173 A1 11/2005
GB 2365025 A 2/2002

OTHER PUBLICATIONS

Canadian Office Action for Canadian Application No. 2,747,738 dated dated Aug. 2, 2013, 3 pages.
(Continued)

*Primary Examiner* — Christopher S Kessler
(74) *Attorney, Agent, or Firm* — TraskBritt

(57) ABSTRACT

Methods of fabricating bodies of earth-boring tools include mechanically injecting a powder mixture into a mold cavity, pressurizing the powder mixture within the mold cavity to form a green body, and sintering the green body to a desired final density to form at least a portion of a body of an earth-boring tool. For example, a green bit body may be injection molded, and the green bit body may be sintered to form at least a portion of a bit body of an earth-boring rotary drill bit. Intermediate structures formed during fabrication of an earth-boring tool include green bodies having a plurality of hard particles, a plurality of matrix particles comprising a metal matrix material, and an organic material that includes a long chain fatty acid derivative. Structures formed using the methods of fabrication are also disclosed.

20 Claims, 4 Drawing Sheets

(51) Int. Cl.

| | |
|---|---|
| ***C22C 1/05*** | (2006.01) |
| ***C22C 29/02*** | (2006.01) |
| ***B22F 3/22*** | (2006.01) |
| ***B22F 1/00*** | (2006.01) |
| ***B22F 3/24*** | (2006.01) |
| ***B22F 5/00*** | (2006.01) |

(52) U.S. Cl.
CPC ..... *B22F 5/00* (2013.01); *C22C 1/051* (2013.01); *C22C 29/02* (2013.01); *B22F 2003/247* (2013.01); *B22F 2005/001* (2013.01); *B22F 2998/10* (2013.01)

(56) References Cited

U.S. PATENT DOCUMENTS

| | | | |
|---|---|---|---|
| 4,233,720 | A | 11/1980 | Rozmus |
| 4,341,557 | A | 7/1982 | Lizenby |
| 4,499,048 | A | 2/1985 | Janejko |
| 4,526,748 | A | 7/1985 | Rozmus |
| 4,547,337 | A | 10/1985 | Rozmus |
| 4,562,990 | A | 1/1986 | Rose |
| 4,596,694 | A | 6/1986 | Rozmus |
| 4,597,730 | A | 7/1986 | Rozmus |
| 4,656,002 | A | 4/1987 | Lizenby et al. |
| 4,744,943 | A | 5/1988 | Timm et al. |
| 5,032,352 | A | 7/1991 | Meeks et al. |
| 5,080,714 | A | 1/1992 | Achikita et al. |
| 5,095,048 | A | 3/1992 | Takahashi et al. |
| 5,131,725 | A | 7/1992 | Rowlett et al. |
| 5,137,398 | A | 8/1992 | Omori et al. |
| 5,154,550 | A | 10/1992 | Isobe et al. |
| 5,186,739 | A | 2/1993 | Isobe et al. |
| 5,232,522 | A | 8/1993 | Doktycz et al. |
| 5,281,650 | A | 1/1994 | Burk |
| 5,342,563 | A | 8/1994 | Quinn et al. |
| 5,379,853 | A | 1/1995 | Lockwood et al. |
| 5,417,756 | A | 5/1995 | Bayer et al. |
| 5,421,853 | A | 6/1995 | Chen et al. |
| 5,427,734 | A | 6/1995 | Yamashita et al. |
| 5,527,624 | A | 6/1996 | Higgins et al. |
| 5,854,379 | A | 12/1998 | Takayama et al. |
| 5,935,315 | A | 8/1999 | Bostrom |
| 5,950,063 | A | 9/1999 | Hens et al. |
| 5,958,283 | A | 9/1999 | Schmid et al. |
| 5,963,775 | A | 10/1999 | Fang et al. |
| 5,989,304 | A | 11/1999 | Ozaki et al. |
| 6,051,184 | A | 4/2000 | Kankawa et al. |
| 6,595,305 | B1 | 7/2003 | Dunn et al. |
| 6,641,640 | B1 | 11/2003 | Hesse et al. |
| 6,860,344 | B2 | 3/2005 | Bise |
| 7,235,211 | B2 | 6/2007 | Griffo et al. |
| 7,250,069 | B2 | 7/2007 | Kembaiyan et al. |
| 7,259,219 | B2 | 8/2007 | Rosen et al. |
| 7,264,646 | B2 | 9/2007 | Hammond |
| 7,322,776 | B2 | 1/2008 | Webb et al. |
| 2002/0029909 | A1 | 3/2002 | Griffo et al. |
| 2003/0114553 | A1 | 6/2003 | Karim et al. |
| 2005/0247491 | A1 | 11/2005 | Mirchandani et al. |
| 2006/0165973 | A1 | 7/2006 | Dumm et al. |
| 2007/0049484 | A1 | 3/2007 | Kear et al. |
| 2007/0081870 | A1 | 4/2007 | Muhlfriedel et al. |
| 2007/0092727 | A1 | 4/2007 | Kosters et al. |
| 2007/0102198 | A1 | 5/2007 | Oxford et al. |
| 2007/0102199 | A1 | 5/2007 | Smith et al. |
| 2007/0108650 | A1 | 5/2007 | Mirchandani et al. |
| 2007/0207715 | A1 | 9/2007 | Webb |
| 2008/0056929 | A1 | 3/2008 | Nakai et al. |
| 2008/0127781 | A1 | 6/2008 | Ladi et al. |
| 2008/0135308 | A1 | 6/2008 | Lundberg |
| 2008/0138162 | A1 | 6/2008 | Webb et al. |
| 2008/0274002 | A1 | 11/2008 | Lombardi |
| 2010/0154587 | A1 | 6/2010 | Eason |

OTHER PUBLICATIONS

DUOMEEN® TDO, Pigment Dispersing Agent, Akso Nobel Surface Chemistry LLC, http://surface, akzonobelusa.com, 7 pages (no date).

German, Rand M., Powder Injection Molding, ASM Handbook, vol. 7 (1998), pp. 355-364.

International Preliminary Report on Patentability, for International Application No. PCT/US2009/068407, dated Jun. 29, 2011, 5 pages.

International Search Report dated Jul. 1, 2010 as filed in corresponding PCT Application No. PCT/US2009/068407, 4 pages.

International Written Opinion of the International Search Authority for International Application No. PCT/US2009/068407, dated Jun. 28, 2010, 4 pages.

Richerson, David W., "Modern Ceramic Engineering, Properties, Processing, and Use in Design," Second Edition, Revised and Expanded, ©1992 by Marcel Dekker, Inc., New York, NY, pp. 488-511.

Supplemental European Search Report for European Application No. 09835631.4 dated Dec. 16, 2013, 2 pages.

METHODS OF FORMING BODIES FOR EARTH-BORING DRILLING TOOLS COMPRISING MOLDING AND SINTERING TECHNIQUES

CROSS-REFERENCE TO RELATED APPLICATION

This application is a continuation of U.S. patent application Ser. No. 12/341,663, filed Dec. 22, 2008, now U.S. Pat. No. 9,139,893, issued Sep. 22, 2015 the disclosure of which is hereby incorporated herein in its entirety by this reference.

TECHNICAL FIELD

Embodiments of the present invention relate generally to methods of forming bodies of tools for use in forming wellbores in subterranean earth formations, and to structures formed by such methods.

BACKGROUND

Wellbores are formed in subterranean earth formations for many purposes including, for example, oil and gas extraction and geothermal energy extraction. Many tools are used in the formation and completion of wellbores in subterranean earth formations. For example, earth-boring drill bits such as rotary drill bits including, for example, so-called "fixed cutter" drill bits, "roller cone" drill bits, and "impregnated diamond" drill bits are often used to drill a wellbore into an earth formation. Coring or core bits, eccentric bits, and bi-center bits are additional types of rotary drill bits that may be used in the formation and completion of wellbores. Other earth-boring tools may be used to enlarge the diameter of a wellbore previously drilled with a drill bit. Such tools include, for example, so-called "reamers" and "under-reamers." Other tools may be used in the completion of wellbores including, for example, milling tools or "mills," which may be used to form an opening in a casing or liner section that has been provided within a previously drilled wellbore. As used herein, the term "earth-boring tools" means and includes any tool that may be used in the formation and completion of a wellbore in an earth formation, including those tools mentioned above.

Earth-boring tools are subjected to extreme forces during use. For example, earth-boring rotary drill bits may be subjected to high longitudinal forces (the so-called "weight-on-bit" (WOB)), as well as to high torques. The materials from which earth-boring tools are fabricated must be capable of withstanding such mechanical forces. Furthermore, earth-boring rotary drill bits may be subjected to abrasion and erosion during use. The term "abrasion" refers to a three body wear mechanism that includes two surfaces of solid materials sliding past one another with solid particulate material therebetween, such as may occur when a surface of a drill bit slides past an adjacent surface of an earth formation with detritus or particulate material therebetween during a drilling operation. The term "erosion" refers to a two body wear mechanism that occurs when solid particulate material, a fluid, or a fluid carrying solid particulate material impinges on a solid surface, such as may occur when drilling fluid is pumped through and around a drill bit during a drilling operation. The materials from which earth-boring drill bits are fabricated must also be capable of withstanding the abrasive and erosive conditions experienced within the wellbore during a drilling operation.

The material requirements for earth-boring tools are relatively demanding. Many earth-boring tools are fabricated from composite materials that include a discontinuous hard phase that is dispersed through a continuous matrix phase. The hard phase may be formed using hard particles, and, as a result, the composition materials are often referred to as "particle-matrix composite materials." The hard phase of such composite materials may comprise, for example, diamond, boron carbide, boron nitride, aluminum nitride, silicon nitride, and carbides or borides of W, Ti, Mo, Nb, V, Hf, Zr, Si, Ta, and Cr. The matrix material of such composite materials may comprise, for example, copper-based alloys, iron-based alloys, nickel-based alloys, cobalt-based alloys, titanium-based alloys, and aluminum-based alloys. As used herein, the teen "[metal]-based alloy" (where [metal] is a metal) means commercially pure [metal] in addition to metal alloys wherein the weight percentage of [metal] in the alloy is greater than or equal to the weight percentage of all other components of the alloy individually.

The bodies of earth-boring tools may be relatively large structures that may have relatively tight dimensional tolerance requirements. As a result, the methods used to fabricate such bodies of earth-boring tools must be capable of producing relatively large structures that meet the relatively tight dimensional tolerance requirement. As the materials from which the earth-boring tools must be fabricated must be resistant to abrasion and erosion, the materials may not be easily machined using conventional turning, milling, and drilling techniques. Therefore, the number of manufacturing techniques that may be used to successfully fabricate such bodies of earth-boring tools is limited. Furthermore, it may be difficult or impossible to form a body of an earth-boring tool from certain composite materials using certain techniques. For example, it may be difficult to fabricate bit bodies for earth-boring rotary drill bits comprising certain compositions of particle-matrix composite materials using conventional infiltration fabrication techniques, in which a bed of hard particles is infiltrated with molten matrix material, which is subsequently allowed to cool and solidify.

As a result of these and other material limitations and manufacturing technique limitations, earth-boring tools may be fabricated using less than optimum materials or they may be fabricated using techniques that are not economically feasible for large scale production.

In view of the above, there is a need in the art for new manufacturing techniques that may be used to fabricate earth-boring tools to within desirable dimensional tolerances, and that also may be used to fabricate earth-boring tools comprising materials that exhibit relatively high wear resistance and erosion resistance.

BRIEF SUMMARY

In some embodiments, the present invention includes methods of fabricating bodies of earth-boring tools in which a powder mixture is mechanically injected into a mold cavity to form a green body, and the green body is sintered to form at least a portion of a body of an earth-boring tool. The powder mixture may be formed by mixing hard particles, matrix particles that comprise a metal matrix material, and an organic material. As the powder mixture is injected into the mold cavity, pressure may be applied to the powder mixture to form a green body, which may be sintered to form at least a portion of a body of an earth-boring tool. As used herein, the term "body" is inclusive and not exclusive, and contemplates various components of earth-boring tools other than, and in addition, to, a tool "body" per se.

In additional embodiments of the present invention, bit bodies of earth-boring rotary drill bits are fabricated by injection molding a green bit body comprising a plurality of hard particles, a plurality of matrix particles comprising a metal matrix material, and an organic material, and the green bit bodies are sintered to form an at least substantially fully dense bit body of an earth-boring rotary drill bit.

Further embodiments of the present invention include structures formed through such methods. For example, embodiments of the present invention also include intermediate structures formed during fabrication of a body of an earth-boring tool. The intermediate structures comprise a green body having a shape corresponding to a body of an earth-boring tool. The green body includes a plurality of hard particles, a plurality of matrix particles comprising a metal matrix material, and an organic material that includes a long chain fatty acid derivative.

BRIEF DESCRIPTION OF THE DRAWINGS

While the specification concludes with claims particularly pointing out and distinctly claiming that which is regarded as the present invention, the advantages of this invention may be more readily ascertained from the description of the invention when read in conjunction with the accompanying drawings, in which:

DETAILED DESCRIPTION

The illustrations presented herein are not meant to be actual views of any particular material, apparatus, system, or method, but are merely idealized representations that are employed to describe the present invention. Additionally, elements common between figures may retain the same numerical designation.

Figure 1:
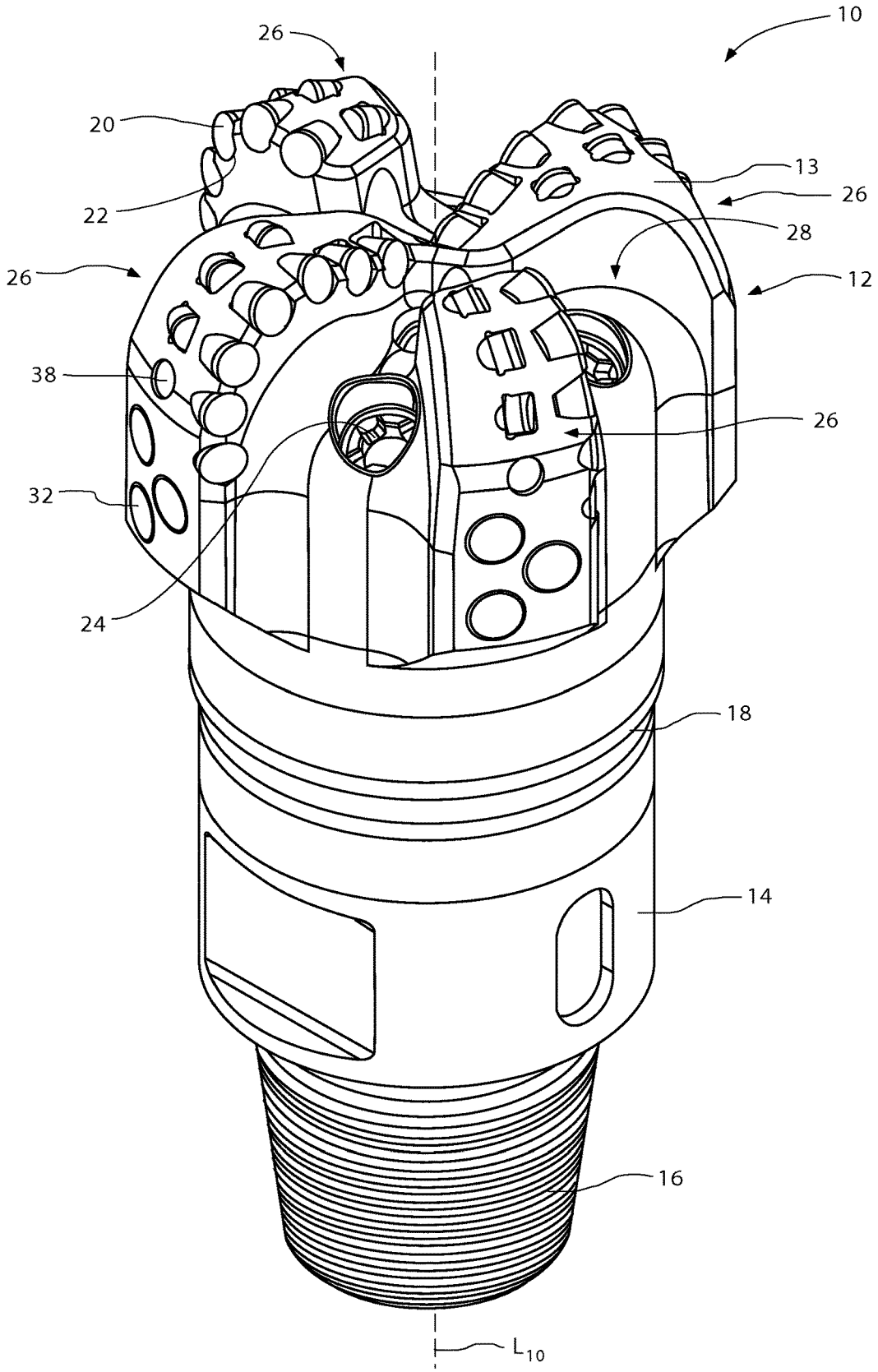
FIG. 1 is a perspective view of one embodiment of an earth-boring rotary drill bit that includes a bit body that may be formed in accordance with embodiments of methods of the present invention.

Embodiments of the present invention include methods of forming a body of an earth-boring tool such as, for example, a bit body of an earth-boring rotary drill bit. FIG. 1 is a perspective view of an earth-boring rotary drill bit 10 that includes a bit body 12 that may be formed using embodiments of methods of the present invention. The bit body 12 may be secured to a shank 14 having a threaded connection portion 16 (e.g., an American Petroleum Institute (API) threaded connection portion) for attaching the drill bit 10 to a drill string (not shown). In some embodiments, such as that shown in FIG. 1, the bit body 12 may be secured to the shank 14 using an extension 18. In other embodiments, the bit body 12 may be secured directly to the shank 14. Methods and structures that may be used to secure the bit body 12 to the shank 14 are disclosed in, for example, U.S. Pat. No. 7,802,495, issued Sep. 28, 2010, and U.S. Pat. No. 7,776,256, issued Aug. 17, 2010, both of which are assigned to the assignee of the present invention, and the entire disclosure of each of which is incorporated herein by this reference.

The bit body 12 may include internal fluid passageways (not shown) that extend between the face 13 of the bit body 12 and a longitudinal bore (not shown), which extends through the shank 14, the extension 18, and partially through the bit body 12. Nozzle inserts 24 also may be provided at the face 13 of the bit body 12 within the internal fluid passageways. The bit body 12 may further include a plurality of blades 26 that are separated by junk slots 28. In some embodiments, the bit body 12 may include gage wear plugs 32 and wear knots 38. A plurality of cutting elements 20 (which may include, for example, PDC cutting elements) may be mounted on the face 13 of the bit body 12 in cutting element pockets 22 that are located along each of the blades 26. The bit body 12 of the earth-boring rotary drill bit 10 shown in FIG. 1 may comprise a particle-matrix composite material that includes hard particles (a discontinuous phase) dispersed within a metallic matrix material (a continuous phase).

Broadly, the methods comprise injecting a powder mixture into a cavity within a mold to form a green body, and the green body then may be sintered to a desired final density to form a body of an earth-boring tool. Such processes are often referred to in the art as metal injection molding (MIM) or powder injection molding (PIM) processes. The powder mixture may be mechanically injected into the mold cavity using, for example, an injection molding process or a transfer molding process. To form a powder mixture for use in embodiments of methods of the present invention, a plurality of hard particles may be mixed with a plurality of matrix particles that comprise a metal matrix material. An organic material also may be included in the powder mixture. The organic material may comprise a material that acts as a lubricant to aid in particle compaction during a molding process.

The hard particles of the powder mixture may comprise diamond, or may comprise ceramic materials such as carbides, nitrides, oxides, and borides (including boron carbide ($B_4C$)). More specifically, the hard particles may comprise carbides and borides made from elements such as W, Ti, Mo, Nb, V, Hf, Ta, Cr, Zr, Al, and Si. By way of example and not limitation, materials that may be used to form hard particles include tungsten carbide, titanium carbide (TiC), tantalum carbide (TaC), titanium diboride ($TiB_2$), chromium carbide, titanium nitride (TiN), aluminum oxide ($Al_2O_3$), aluminum nitride (AlN), boron nitride (BN), silicon nitride ($Si_3N_4$), and silicon carbide (SiC). Furthermore, combinations of different hard particles may be used to tailor the physical properties and characteristics of the particle-matrix composite material. The hard particles may be formed using techniques known to those of ordinary skill in the art. Most suitable materials for hard particles are commercially available and the formation of the remainder is within the ability of one of ordinary skill in the art.

The matrix particles of the powder mixture may comprise, for example, cobalt-based, iron-based, nickel-based, aluminum-based, copper-based, magnesium-based, and titanium-based alloys. The matrix material may also be selected from commercially pure elements such as cobalt, aluminum, copper, magnesium, titanium, iron, and nickel. By way of example and not limitation, the matrix material may include carbon steel, alloy steel, stainless steel, tool steel, Hadfield manganese steel, nickel or cobalt superalloy material, and low thermal expansion iron- or nickel-based alloys such as INVAR®. As used herein, the term "superalloy" refers to iron-, nickel-, and cobalt-based alloys having at least 12% chromium by weight. Additional example alloys that may be used as matrix material include austenitic steels, nickel-based superalloys such as INCONEL® 625M or Rene 95, and INVAR® type alloys having a coefficient of thermal expansion that closely matches that of the hard particles used in the particular particle-matrix composite material. More closely matching the coefficient of thermal expansion of matrix material with that of the hard particles offers advantages such as reducing problems associated with residual stresses and thermal fatigue. Another example of a matrix material is a Hadfield austenitic manganese steel (Fe with approximately 12% Mn by weight and 1.1% C by weight).

In some embodiments of the present invention, the hard particles and the matrix particles of the powder mixture may have a multi-modal particle size distribution. For example, the powder mixture may be comprised of a first group of particles having a first average particle size, a second group of particles having a second average particle size about seven times greater than the first average particle size, and a third group of particles having an average particle size about thirty-five times greater than the first average particle size. Each group may comprise both hard particles and matrix particles, or one or more of the groups may be at least substantially comprised of either hard particles or matrix particles. By forming the powder mixture to have a multi-modal particle size distribution, it may be possible to increase the packing density of the powder mixture within a mold.

Additionally, in some embodiments of the present invention, the hard particles and the matrix particles may be at least generally spherical. For example, the hard particles and the matrix particles of the powder mixture may have a generally spherical shape having an average sphericity ($\Psi$) of 0.6 or higher, wherein the sphericity ($\Psi$) is defined by the equation:

$$\Psi = D_I / D_C,$$

in which $D_C$ is the smallest circle capable of circumscribing a cross-section of the particle that extends through or near the center of the particle, and $D_I$ is the largest circle that may be inscribed a cross-section of the particle extending through or near the center of the particle. In additional embodiments, the hard particles and the matrix particles of the powder mixture may have an at least substantially spherical shape and may have an average sphericity ($\Psi$) of 0.9 or greater. Increasing the sphericity of the particles in the powder mixture may reduce inter-particle friction as the powder mixture is mechanically injected into a mold under pressure, which may allow the packing density of the powder mixture within the mold to be increased. Furthermore, a reduction in inter-particle friction also may enable attainment of a relatively more uniform packing density of the powder mixture within the mold.

The organic material of the powder mixture may comprise one or more binders for providing lubrication during pressing and for providing structural strength to the pressed powder component, one or more plasticizers for making the binder more pliable, and one or more lubricants or compaction aids for reducing inter-particle friction. The hard particles and the matrix particles of the powder mixture may be coated with the organic material prior to using the powder mixture in a molding process as described herein below. The organic material may comprise less than about 5% by weight of the powder mixture.

Figure 2:
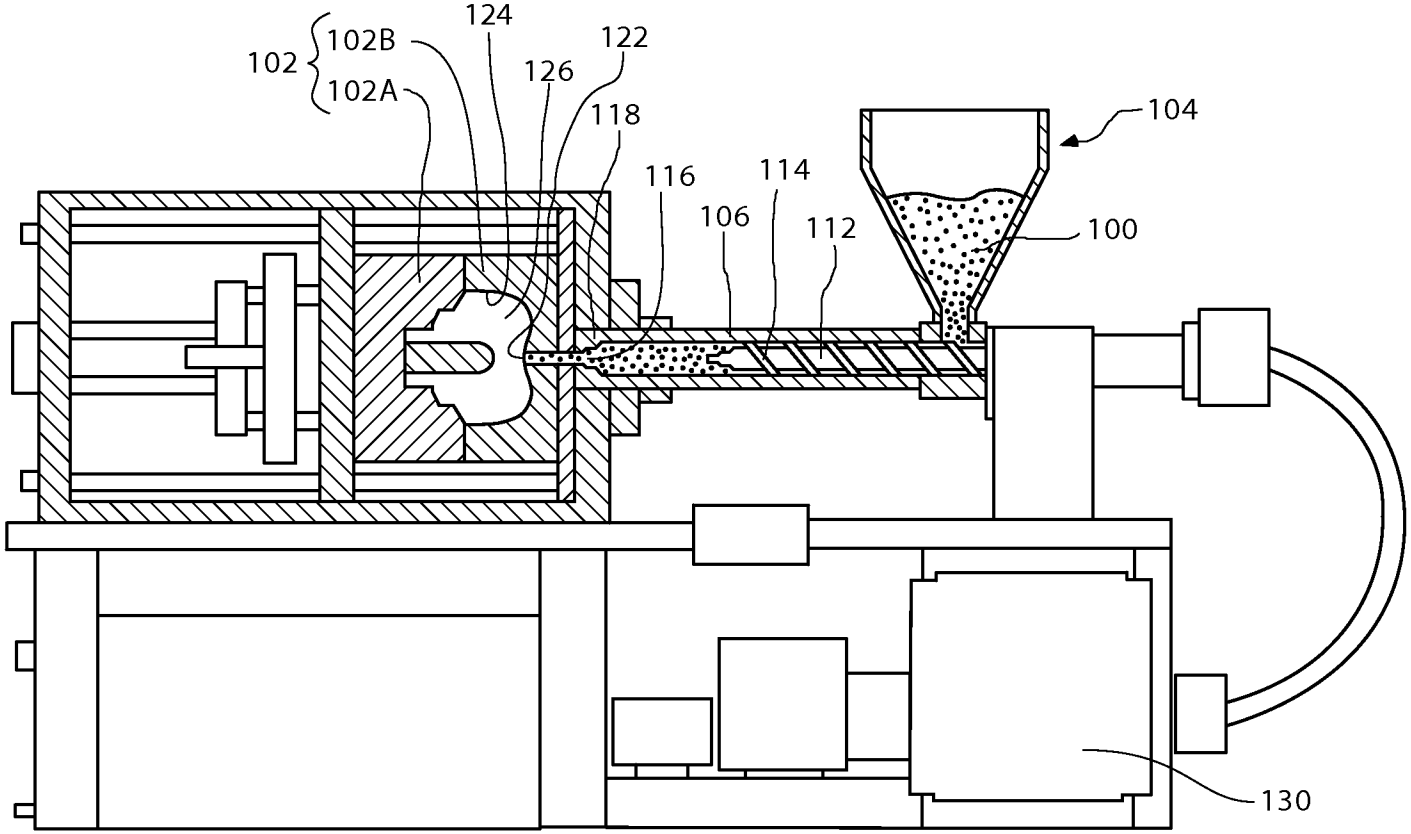
FIG. 2 is a schematic illustration used to describe embodiments of methods of the present invention in which an injection molding process is used to form a green body that may be sintered to form a body of an earth-boring tool.

The organic material in powder mixture 100, shown in FIG. 2, also may comprise one or more of a thermoplastic polymer material (such as, for example, polyethylene, polystyrene, polybutylene, polysulfone, nylon, or acrylic), a thermosetting polymer material (such as, for example, epoxy, polyphenylene, or phenol formaldehyde), a wax having a relatively higher volatilizing temperature (such as, for example, paraffin wax), a long chain fatty acid derivative, and an oil having a relatively lower volatilizing temperature (such as, for example, animal, vegetable, or mineral oil). By way of example and not limitation, the organic material may comprise, for example, an alkylenepolyamine as disclosed in U.S. Pat. No. 5,527,624 to Higgins et al., the contents of which are incorporated herein in their entirety by this reference. Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris(2-aminoethyl)amine, propylenediamine, trimethylenediamine, tripropylenetetramine, tetraethylenepentamine, hexaethyleneheptamine, pentaethylenehexamine, etc.

An embodiment of a method according to the present invention in which a body of an earth-boring tool is fabricated using an injection molding process is described below with reference to FIG. 2. A powder mixture 100 as described above may be mechanically injected into a mold 102 using an injection molding process to form a green bit body, such as the green bit body 300 shown in FIG. 4 and described in further detail herein below. As shown in FIG. 2, the powder mixture 100 may be provided within a hopper 104. The powder mixture 100 may pass from the hopper 104 into a barrel 106 through an opening in an outer wall of the barrel 106. A screw 112 disposed within the barrel 106 may be translated longitudinally within the barrel 106, and also may be rotated within the barrel 106, using a motor 130 such as, for example, an electric motor, a hydraulic motor, a pneumatic motor, etc.

During a molding process, a forward end 118 of the barrel 106 may be abutted against a surface of mold 102 such that a nozzle opening 116 in the forward end 118 of the barrel 106 communicates with an opening 122 in an outer wall 124 of the mold 102. The opening 122 in the outer wall 124 of the mold 102 leads to a mold cavity 126 within the mold 102 having a shape corresponding to the shape of at least a portion of a body of an earth-boring tool to be manufactured using the molding process. The screw 112, which may initially be in a longitudinally forwardmost position within the barrel 106, may be rotated within the barrel 106, which causes threads 114 on the screw 112 to force the powder mixture 100 within the barrel 106 in a longitudinally forward direction therein (toward the mold 102), which also causes the screw 112 to slide in a rearward direction (away from the mold 102) within the barrel 106. After a selected amount of powder mixture 100 has been moved to the front of the screw 112 within the barrel 106, rotation of the screw 112 may be halted, and the screw 112 may be forced in the longitudinally forward direction within the barrel 106, which will cause the powder mixture 100 in front of the screw 112 within the barrel 106 to pass through the nozzle opening 116 in the forward end 118 of the barrel 106, through the opening in the outer wall 124 of the mold 102, and into the mold cavity 126. As the screw 112 continues to slide in the forward direction within the barrel 106, the mold cavity 126 will fill with the powder mixture 100.

As the mold cavity 126 becomes completely filled with relatively loosely packed particles of the powder mixture 100, further forward movement of the screw 112 will cause the pressure within the mold cavity 126 to rise as additional particles of the powder mixture 100 are forced into the mold cavity 126. The increased pressure within the mold cavity 126 may cause the particles of the powder mixture 100 to further compact until a desired density of the powder mixture 100 within the mold cavity 126 is achieved. By way of example and not limitation, the screw 112 may be translated in the forward direction within the barrel 106 until a pressure of between about 10 pounds per square inch (about 0.07 megapascals) and about 100 pounds per square inch (about 0.7 megapascals) is applied to the powder mixture 100 within the mold cavity 126.

In additional embodiments, the mold cavity 126 may be placed under vacuum, and a metered amount of the powder mixture 100 may be allowed to be pulled into the mold cavity 126 by the vacuum therein. Such a process may reduce the presence of voids and other defects within the green bit body 300 (FIG. 4) upon completion of the molding process. In such embodiments, the metered amount of the powder mixture 100 may be heated to an elevated temperature to melt and/or reduce a viscosity of any organic material therein prior to allowing the powder mixture 100 to be drawn into the mold cavity 126 by the vacuum.

The mold 102 may comprise two or more separable components, such as, for example, a first mold half 102A and a second mold half 102B, as shown in FIG. 2. After the molding cycle, the two or more separable components may be separated to facilitate removal of the green bit body 300 (FIG. 4) from the mold 102.

In additional embodiments, the mold 102 may comprise a water soluble material such as, for example, polyvinyl alcohol (PVA) or polyethylene glycol. In such embodiments, the green bit body 300 (FIG. 4) may be removed from the mold 102 by dissolving the mold 102 in water or another polar solvent. As the green bit body 300 may comprise an organic additive, the green bit body 300 may be hydrophobic, such that the green bit body 300 will not dissolve as the mold 102 is dissolved away from the green bit body 300. In such embodiments, the mold 102 may comprise a single, monolithic structure, which may be formed using, for example, a casting process or a molding process (e.g., an injection molding process), or the mold 102 may comprise two or more separable components.

The mold 102 may further comprise inserts used to define internal cavities or passageways (e.g., fluid passageways), as known in the art.

Figure 3:
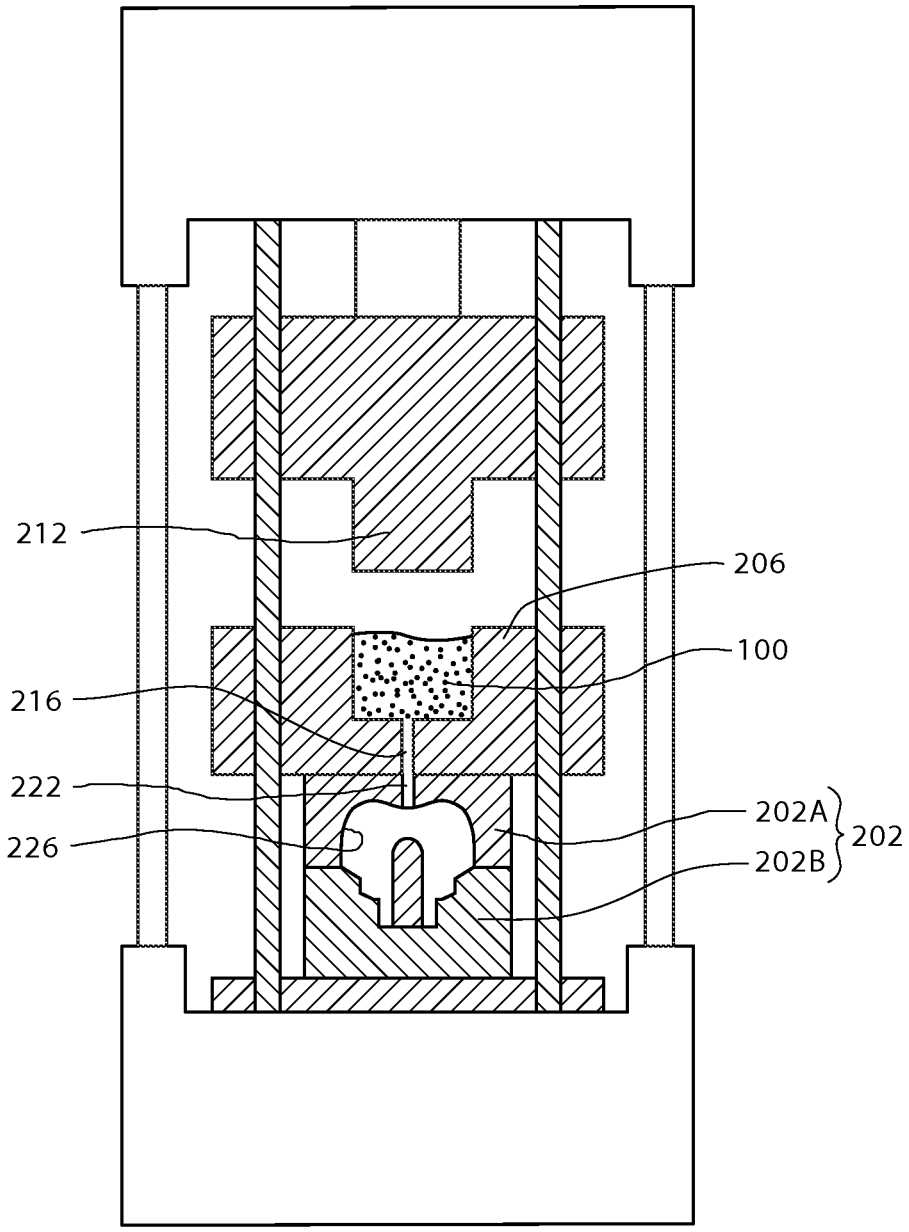
FIG. 3 is a schematic illustration used to describe embodiments of methods of the present invention in which a transfer molding process is used to form a green body that may be sintered to form a body of an earth-boring tool.

An embodiment of a method according to the present invention in which a body of an earth-boring tool is fabricated using a transfer molding process is described below with reference to FIG. 3. A powder mixture 100 as described above may be mechanically injected into a mold 202 using a transfer molding process to form a green bit body, such as the green bit body 300 shown in FIG. 4 and described in further detail herein below. As shown in FIG. 3, a predetermined quantity of a powder mixture 100 as described above may be provided within a pot 206. A piston 212 may be pushed through the pot 206 to force the powder mixture 100 into the mold 202. The piston 212 may be forced through the pot 206 using, for example, mechanical actuation, hydraulic pressure, or pneumatic pressure.

During a molding process, the pot 206 may be abutted against a surface of the mold 202 such that an opening 216 in the pot 206 communicates with an opening 222 in the mold 202. The opening 222 in the mold 202 leads to a mold cavity 226 within the mold 202 having a shape corresponding to the shape of at least a portion of a body of an earth-boring tool to be manufactured using the molding process. The piston 212 may be forced through the pot 206, which forces the predetermined quantity of the powder mixture 100 within the pot 206 thorough the opening 216 in the pot 206, through the opening 222 in the mold 202, and into the mold cavity 226. As the piston 212 continues to translate through the pot 206, the mold cavity 226 will fill with the powder mixture 100. As the mold cavity 226 becomes completely filled with relatively loosely packed particles of the powder mixture 100, further translation of the piston 212 will cause the pressure within the mold cavity 226 to rise as additional particles of the powder mixture 100 are forced into the mold cavity 226. The increased pressure within the mold cavity 226 may cause the particles of the powder mixture 100 to further compact until a desired packing density of the powder mixture 100 within the mold cavity 226 is achieved. By way of example and not limitation, the piston 212 may be forced longitudinally within the pot 206 to achieve the packing pressures and packing densities (in the mold cavity 226) that were previously described in relation to injection molding methods with reference to FIG. 2.

The mold 202 may comprise two or more separable components, such as, for example, a first mold half 202A and a second mold half 202B, as shown in FIG. 3. After the molding cycle, the two or more separable components may be separated to facilitate removal of the green bit body 300 (FIG. 4) from the mold 202.

As known in the art, the mold 202 may comprise one or more vents that lead from the mold cavity 226 to the exterior of the mold 202 to allow air initially within the mold cavity 226 to escape out from the mold cavity 226 as the mold cavity 226 is filling with the powder mixture 100 during a molding cycle. By way of example and not limitation, such vents may be provided by forming one or more grooves in one or both of opposing, abutting surfaces of a first mold half 202A and a second mold half 202B, such that, when the first mold half 202A and the second mold half 202B are assembled together for a molding cycle, air may travel out from the mold cavity 226 through the one or more grooves along the interface between the first mold half 202A and the second mold half 202B.

Figure 4:
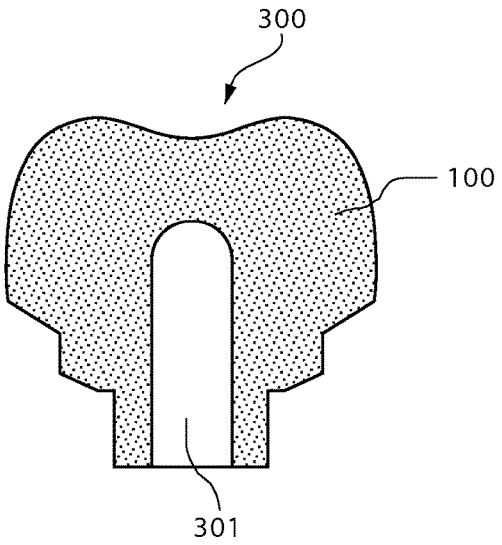
FIG. 4 is a simplified illustration of a green body of an earth-boring tool that may be formed using embodiments of methods of the present invention.

FIG. 4 illustrates a green bit body 300 that may be fabricated using molding techniques (e.g., injection molding techniques and transfer molding techniques) such as those previously described with reference to FIGS. 2 and 3. As shown in FIG. 4, the green bit body 300 is an un-sintered body formed from and comprising the powder mixture 100. The green bit body 300 has an exterior shape corresponding to that of the body of the earth-boring tool to be fabricated. For example, the green bit body 300 may comprise a plurality of blades and junk slots (similar to the blades 26 and junk slots 28 shown in FIG. 1), and may comprise an internal fluid passageway or plenum 301.

It is understood, however, that the green bit body 300 may not have an exterior shape identical to that of the body of the earth-boring tool to be fabricated, and the green bit body 300 may be modified by adding or removing some of the powder mixture 100 from the green bit body 300. For example, some features may be formed in the green bit body 300 by machining the green bit body 300 after the molding process.

If the powder mixture 100 used in a molding cycle has a paste-like texture, additional material of the powder mixture 100 may be manually applied to surfaces of the green bit body 300 using hand-held tools if necessary or desirable for attaining a predefined geometry for the various surfaces of the green bit body 300. If the powder mixture 100 used in a molding cycle does not have a paste-like texture, organic materials such as those previously described herein may be applied to a portion of the powder mixture 100 to cause that portion to have a paste-like texture, and the portion then may be applied to surfaces of the green bit body 300 as previously mentioned.

After molding the green bit body 300, the green bit body 300 optionally may be subjected to a pressing process to increase the density of the green bit body 300, which may reduce or minimize the extent to which the green bit body 300 shrinks upon sintering, as discussed herein below. By way of example and not limitation, the green bit body 300 may be subjected to at least substantially isostatic pressure in an isostatic pressing process. By way of example and not limitation, the green bit body 300 may be placed in a fluid-tight deformable bag. In other embodiments, all exposed surfaces of the green bit body 300 may be coated with a deformable, fluid-impermeable coating comprising, for example, a thermoplastic polymer material or a thermosetting polymer material. The green bit body 300 (within the deformable bag or coating) then may be submersed within a fluid in a pressure vessel, and the fluid pressure may be increased within the pressure vessel to apply at least substantially isostatic pressure to the green bit body 300 therein. The pressure within the pressure vessel during isostatic pressing of the green bit body 300 may be greater than about 35 megapascals (about 5,000 pounds per square inch). More particularly, the pressure within the pressure vessel during isostatic pressing of the green bit body may be greater than about 138 megapascals (20,000 pounds per square inch).

Although it may be preferable to mold the green bit body 300 such that the green bit body 300 does not require further machining prior to sintering, in some embodiments, it may not be feasible or practical to mold the green bit body 300 to a desired final shape prior to sintering. Optionally, certain structural features may be machined in the green bit body 300 using conventional machining techniques including, for example, turning techniques, milling techniques, and drilling techniques. Hand held tools also may be used to manually form or shape features in or on the green bit body 300. By way of example and not limitation, cutter pockets may be machined or otherwise formed in the green bit body 300 after the molding process.

Figure 5:
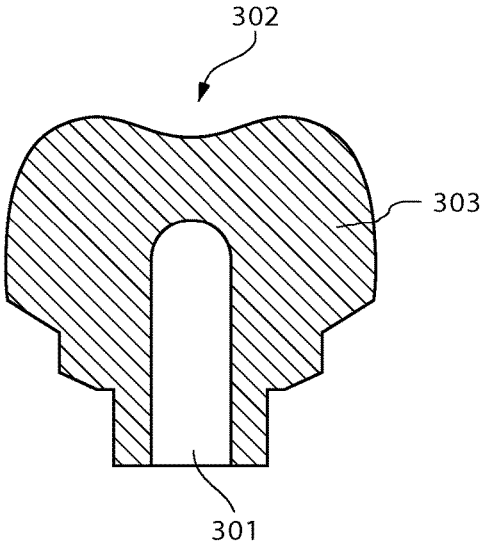
FIG. 5 is a simplified illustration of a brown body of an earth-boring tool that may be formed by partially sintering the green body shown in FIG. 4.

The molded green bit body 300 also may be at least partially sintered to provide a brown bit body 302 shown in FIG. 5, which has less than a desired final density. The brown bit body 302 may comprise a porous (less than fully dense) particle-matrix composite material 303 formed by partially sintering the powder mixture 100 of the green bit body 300 (FIG. 4). Prior to partially sintering the green bit body 300, the green bit body 300 may be subjected to moderately elevated temperatures and pressures to burn off or remove any fugitive additives that were included in the powder mixture 100, as previously described. Furthermore, the green bit body 300 may be subjected to a suitable atmosphere tailored to aid in the removal of such additives. Such atmospheres may include, for example, hydrogen gas at temperatures of about 500° C.

Figure 6:
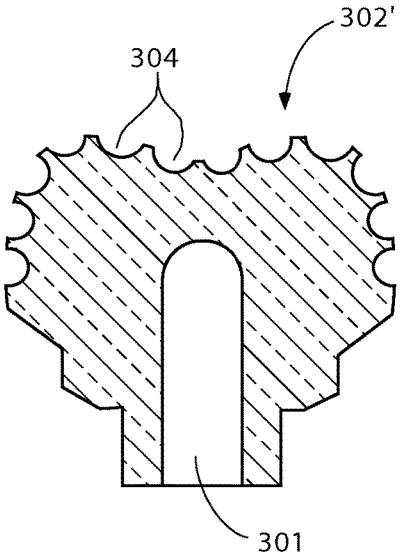
FIG. 6 is a simplified illustration of another brown body of an earth-boring tool that may be formed by machining the brown body shown in FIG. 5.

It may be practical to machine the brown bit body 302 due to the remaining porosity in the particle-matrix composite material 303. Certain structural features may be machined in the brown bit body 302 using conventional machining techniques including, for example, turning techniques, milling techniques, and drilling techniques. Hand held tools also may be used to manually form or shape features in or on the brown bit body 302. Tools that include superhard coatings or inserts may be used to facilitate machining of the brown bit body 302. Additionally, material coatings may be applied to surfaces of the brown bit body 302 that are to be machined to reduce chipping of the brown bit body 302. Such coatings may include a fixative or other polymer material. By way of example and not limitation, cutter pockets 304 may be machined or otherwise formed in the brown bit body 302 to form the modified brown bit body 302' shown in FIG. 6.

After performing any desirable machining, the brown bit body 302 (or the modified brown bit body 302') then may be fully sintered to a desired final density to provide the bit body of the earth-boring rotary drill bit being fabricated, such as the bit body 12 of the drill bit 10 shown in FIG. 1.

As sintering involves densification and removal of porosity within a structure, the structure being sintered will shrink during the sintering process. A structure may experience linear shrinkage of between 10% and 20% during sintering from a green state to a desired final density. As a result, dimensional shrinkage must be considered and accounted for when designing tooling (molds, dies, etc.) or machining features in structures that are less than fully sintered.

The dimensional shrinkage of a green or brown body may be at least partially a function of the density of the green or brown body prior to sintering the green or brown body to a desired final density. A green or brown body having a relatively lower density (e.g., higher porosity) may exhibit a greater amount of shrinkage upon sintering relative to a green or brown body having a relatively higher density (e.g., lower porosity). Similarly, regions within a green or brown body that are relatively less dense may shrink to a greater extent than other regions within the green or brown body that are more dense upon sintering the green or brown body to a desired final density.

Therefore, in order to achieve predictable and at least substantially uniform shrinkage of a green bit body 300 or a brown bit body 302 upon sintering to a desired final density, it may be desirable to achieve, to the greatest extent possible, an at least substantially uniform packing density of the powder mixture 100 in the green bit body 300 upon molding the green bit body 300. Furthermore, it may be desirable to increase or maximize the packing density of the powder mixture 100 within the green bit body 300 in order to reduce or minimize the shrinkage of the green bit body 300 that occurs upon sintering the green bit body 300 to a desired final density to form the sintered bit body 12 (FIG. 1).

In some embodiments of the present invention, the average packing density of the powder mixture 100 within the green bit body 300 may be greater than about eighty percent (80%) by volume. In other words, the green bit body 300 may have an average porosity of less than about twenty percent (20%) by volume.

As bit bodies of earth-boring rotary drill bits (such as the bit body 12 of the drill bit 10 shown in FIG. 1) may be relatively large and may have relatively complex surface geometries, it may be rather difficult to achieve a uniform packing density of the powder mixture 100 within the mold cavity 126 and, hence, within the green bit body 300 upon molding the green bit body 300 from the powder mixture 100. As a result, during molding processes, the organic material of the powder mixture 100 previously described herein may be useful in reducing inter-particle friction as the powder mixture 100 is mechanically injected into a mold cavity, and attaining an at least substantially uniform packing density of the powder mixture 100 within the mold cavity and, hence, within the green bit body 300.

In some embodiments of the invention, it may be desirable, prior to a molding cycle, to manually pre-pack some of the powder mixture 100 into certain regions within the cavity of the mold that may be difficult to completely fill and pack during a molding cycle. In other words, if, after a molding cycle, the mold cavity is not completely filled with the powder mixture 100 (a phenomenon often referred to in the art as a "short"), it may be desirable, for subsequent molding processes, to manually pre-pack some of the powder mixture 100 into those regions of the mold cavity that may not completely fill during the molding cycle. Prepacking certain areas of the mold cavity with the powder mixture 100 may facilitate the complete filling of the mold cavity 126 with the powder mixture and attainment of more uniform packing density during the molding cycle.

During all sintering and partial sintering processes, refractory structures or displacements (not shown) may be used to support at least portions of the bit body during the sintering process to maintain desired shapes and dimensions during the densification process. Such displacements may be used, for example, to maintain consistency in the size and geometry of the cutter pockets and the internal fluid passageways during the sintering process. Such refractory structures may be formed from, for example, graphite, silica, or alumina. The use of alumina displacements instead of graphite displacements may be desirable as alumina may be relatively less reactive than graphite, minimizing atomic diffusion during sintering. Additionally, coatings such as alumina, boron nitride, aluminum nitride, or other commercially available materials may be applied to the refractory structures to prevent carbon or other atoms in the refractory structures from diffusing into the bit body during densification.

In other embodiments, the green bit body 300 (FIG. 4) may be partially sintered to form a brown bit body 302 (FIG. 5) without prior machining, and all necessary machining may be performed on the brown bit body 302 to form a modified brown bit body 302' (FIG. 6), prior to fully sintering the modified brown bit body 302' to a desired final density. Alternatively, all necessary or desired machining may be performed on the green bit body 300, which then may be fully sintered to a desired final density.

The sintering processes described herein may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Furthermore, the sintering processes described herein may include subliquidus phase sintering. In other words, the sintering processes may be conducted at temperatures proximate to but below the liquidus line of the phase diagram for the matrix material. For example, the sintering processes described herein may be conducted using a number of different methods known to one of ordinary skill in the art such as the Rapid Omnidirectional Compaction (ROC) process, the CERACON® process, hot isostatic pressing (HIP), or adaptations of such processes.

Broadly, and by way of example only, sintering a green powder compact using the ROC process involves presintering the green powder compact at a relatively low temperature to only a sufficient degree to develop sufficient strength to permit handling of the powder compact. The resulting brown structure is wrapped in a material such as graphite foil to seal the brown structure. The wrapped brown structure is placed in a container, which is filled with particles of a ceramic, polymer, or glass material having a substantially lower melting point than that of the matrix material in the brown structure. The container is heated to the desired sintering temperature, which is above the melting temperature of the particles of a ceramic, polymer, or glass material, but below the liquidus temperature of the matrix material in the brown structure. The heated container with the molten ceramic, polymer, or glass material (and the brown structure immersed therein) is placed in a mechanical or hydraulic press, such as a forging press, that is used to apply pressure to the molten ceramic or polymer material. Isostatic pressures within the molten ceramic, polymer, or glass material facilitate consolidation and sintering of the brown structure at the elevated temperatures within the container. The molten ceramic, polymer, or glass material acts to transmit the pressure and heat to the brown structure. In this manner, the molten ceramic, polymer, or glass acts as a pressure transmission medium through which pressure is applied to the structure during sintering. Subsequent to the release of pressure and cooling, the sintered structure is then removed from the ceramic, polymer, or glass material. A more detailed explanation of the ROC process and suitable equipment for the practice thereof is provided by U.S. Pat. Nos. 4,094,709, 4,233,720, 4,341,557, 4,526,748, 4,547,337, 4,562,990, 4,596,694, 4,597,730, 4,656,002 4,744,943 and 5,232,522, the disclosure of each of which patents is incorporated herein by reference.

The CERACON® process, which is similar to the aforementioned ROC process, may also be adapted for use in the present invention to fully sinter brown structures to a final density. In the CERACON® process, the brown structures coated with a ceramic coating such as alumina, zirconium oxide, or chrome oxide. Other similar, hard, generally inert, protective, removable coatings may also be used. The coated brown structure is fully consolidated by transmitting at least substantially isostatic pressure to the coated brown structure using ceramic particles instead of a fluid media as in the ROC process. A more detailed explanation of the CERACON® process is provided by U.S. Pat. No. 4,499,048, the disclosure of which patent is incorporated herein by reference.

Furthermore, in embodiments of the invention in which tungsten carbide is used in a particle-matrix composite bit body, the sintering processes described herein also may include a carbon control cycle tailored to improve the stoichiometry of the tungsten carbide material. By way of example and not limitation, if the tungsten carbide material includes WC, the sintering processes described herein may include subjecting the tungsten carbide material to a gaseous mixture including hydrogen and methane at elevated temperatures. For example, the tungsten carbide material may be subjected to a flow of gases including hydrogen and methane at a temperature of about 1,000° C.

After sintering a green bit body 300 or a brown bit body 302 to a desired final density, cutting elements (such as the cutting elements 20 shown in FIG. 1) may be secured within the cutter pockets 304 of the bit body by, for example, brazing the cutting elements within the cutting element pockets.

In additional embodiments of the present invention, two or more portions of a body of an earth-boring tool may be separately molded as previously described herein to form two or more separately formed green components. The separately formed green components then may be assembled together and sintered to bond the green components together to form a body of an earth-boring tool. In other embodiments, the separately formed green components may be partially sintered to form two or more separately formed brown components, and the separately formed brown components then may be assembled together and sintered to bond the brown components together to form a body of an earth-boring tool. As a non-limiting example, a bit body of a fixed-cutter earth-boring rotary drill bit, like the bit body 12 of the drill bit 10 shown in FIG. 1, may be formed by separately forming a green or brown central core component and green or brown blades (such as the blades 26 shown in FIG. 1) using molding processes as previously described herein. The separately formed green or brown blades then may be assembled together with the green or brown central core, and the assembled structure may be sintered to bond the blades to the central core, thereby forming the bit body 12 of the drill bit 10.

In such embodiments, the central core may be formed with a powder mixture 100 having a first composition, and the blades may be formed from a powder mixture 100 having a second, different composition. For example, the central core may be formed from a powder mixture 100 having a composition that will cause the central core to exhibit a relatively higher toughness relative to the blades, and the blades may be formed from a powder mixture 100 having a composition that will cause the blades to exhibit relatively higher wear resistance, relatively higher erosion resistance, or both relatively higher wear resistance and relatively higher erosion resistance relative to the central core.

Although embodiments of methods of the present invention have been described hereinabove with reference to bit bodies of earth-boring rotary drill bits, the methods of the present invention may be used to form bodies of earth-boring tools other than fixed-cutter rotary drill bits including, for example, component bodies of roller cone bits (including bit heads, bit legs, and roller cones), impregnated diamond bits, core bits, eccentric bits, bi-center bits, reamers, mills, and other such tools and structures known in the art.

While the present invention has been described herein with respect to certain embodiments, those of ordinary skill in the art will recognize and appreciate that it is not so limited. Rather, many additions, deletions and modifications to the described embodiments may be made without departing from the scope of the invention as hereinafter claimed, including legal equivalents. In addition, features from one embodiment may be combined with features of another embodiment while still being encompassed within the scope of the invention as contemplated by the inventors.

What is claimed is:

1. A method of fabricating a body of an earth-boring tool, comprising:

forming a powder mixture by mixing hard particles, matrix particles comprising a metal matrix material, and an alkylenepolyamine, wherein the alkylenepolyamine comprises less than about 5% by weight of the powder mixture;

mechanically injecting the powder mixture into a mold cavity under vacuum, the mold cavity having a shape corresponding to at least a portion of a body of an earth-boring tool;

applying a maximum pressure of between about 10 pounds per square inch (about 0.07 megapascals) and about 100 pounds per square inch (about 0.7 megapascals) to the powder mixture within the mold cavity to form a green body; and sintering the green body to form at least a portion of a body of an earth-boring tool.

2. The method of claim 1, wherein forming a powder mixture further comprises selecting the alkylenepolyamine to comprise at least one of a methylenepolyamine, an ethylenepolyamine, a butylenepolyamine, a propylenepolyamine, a pentylenepolyamine, a piperazine, or an N-amino alkyl-substituted piperazine.

3. The method of claim 2, wherein forming a powder mixture further comprises selecting the alkylenepolyamine to comprise at least one of ethylenediamine, triethylenetetramine, tris(2-aminoethyl)amine, propylenediamine, trimethylenediamine, tripropylenetetramine, tetraethylenepentamine, hexaethyleneheptamine, or pentaethylenehexamine.

4. The method of claim 1, further comprising:

forming the mold cavity in a water soluble mold; and dissolving the mold in a polar solvent after forming the green body to remove the green body from the mold cavity.

5. The method of claim 4, further comprising forming the water soluble mold to comprise at least one of polyvinyl alcohol (PVA) and polyethylene glycol.

6. The method of claim 1, further comprising selecting the hard particles to comprise a material selected from the group consisting of diamond, boron carbide, boron nitride, aluminum nitride, silicon nitride, carbides of W, Ti, Mo, Nb, V, Hf, Zr, Si, Ta, and Cr, and borides of W, Ti, Mo, Nb, V, Hf, Zr, Si, Ta, and Cr.

7. The method of claim 6, further comprising selecting the matrix particles to comprise a metal selected from the group consisting of iron, nickel, cobalt, titanium, aluminum, copper-based alloys, iron-based alloys, nickel-based alloys, cobalt-based alloys, titanium-based alloys, and aluminum-based alloys.

8. The method of claim 1, further comprising coating the hard particles and the matrix particles with the alkylenepolyamine prior to injecting the powder mixture into the mold cavity.

9. The method of claim 1, wherein applying a maximum pressure of between about 10 pounds per square inch and about 100 pounds per square inch to the powder mixture comprises forming a green bit body having an average porosity of less than about twenty percent (20%) by volume.

10. The method of claim 1, further comprising isostatically compressing the green body prior to sintering the green body to form at least a portion of a body of an earth-boring tool.

11. The method of claim 1, wherein the powder mixture exhibits a multi-modal particle size distribution.

12. The method of claim 1, further comprising selecting the hard particles and the matrix particles to have an average sphericity of 0.9 or higher.

13. The method of claim 1, wherein mechanically injecting the powder mixture into the mold cavity comprises forcing the powder mixture through a barrel using a rotating screw within the barrel.

14. The method of claim 1, wherein mechanically injecting the powder mixture into the mold cavity comprises forcing the powder mixture through a pot by longitudinally displacing a piston within the pot.

15. A method of fabricating a body of an earth-boring tool, comprising:

forming a mold cavity in a water soluble mold, the mold cavity having a shape corresponding to at least a portion of a body of an earth-boring tool;

coating hard particles and matrix particles with an alkylenepolyamine, wherein the alkylenepolyamine comprises less than about 5% by weight of the powder mixture;

mechanically injecting the coated particles into the mold cavity under vacuum;

applying a maximum pressure of between about 10 pounds per square inch (about 0.07 megapascals) and about 100 pounds per square inch (about 0.7 megapascals) to the powder mixture within the mold cavity to form a green body;

dissolving the mold in a polar solvent after forming the green body to remove the green body from the mold cavity; and sintering the green body to form at least a portion of a body of an earth-boring tool.

16. The method of claim 15, wherein applying a maximum pressure of between about 10 pounds per square inch and about 100 pounds per square inch to the powder mixture comprises forming a green bit body having an average porosity of less than about twenty percent (20%) by volume.

17. The method of claim 15, wherein sintering the green bit body comprises partially sintering the green bit body to form a brown bit body.

18. The method of claim 17, further comprising:

machining the brown bit body; and fully sintering the brown bit body.

19. The method of claim 18, wherein machining the brown bit body comprises machining at least a portion of a cutting element pocket in a surface of the brown bit body.

20. The method of claim 19, further comprising securing at least one cutting element within the cutting element pocket.

* * * * *